US005217269A

United States Patent [19]

Wiltberger

[11] Patent Number: 5,217,269

[45] Date of Patent: Jun. 8, 1993

[54] PORTABLE HANDLED DOOR STOP

[76] Inventor: Charles M. Wiltberger, 23 Meade Ct., Fox Lake, Ill. 60020

[21] Appl. No.: 941,680

[22] Filed: Sep. 8, 1992

[51] Int. Cl.[5] ..... E05C 17/54

[52] U.S. Cl. ..... 292/343; 292/DIG. 38

[58] Field of Search ..... 292/257, 288, 342, 343, 292/258, DIG. 38, DIG. 46

[56] References Cited

U.S. PATENT DOCUMENTS

| | | | |
|---|---|---|---|
| 786,755 | 4/1905 | Grey | 242/339 |
| 3,143,369 | 8/1964 | Adams | 292/288 |
| 3,805,322 | 4/1974 | Serrano | 16/82 |
| 3,967,850 | 7/1976 | Whisler | 296/146 |
| 4,142,752 | 3/1979 | Chilton | 292/343 |
| 4,208,841 | 6/1980 | Starks | 292/343 |
| 4,216,986 | 8/1980 | McNinch et al. | 292/341.17 |
| 4,494,784 | 1/1985 | Haynes | 292/233 |
| 4,514,000 | 4/1985 | Chezem et al. | 292/338 |
| 4,648,152 | 3/1987 | Grewall | 16/82 |
| 4,691,958 | 9/1987 | Miller | 296/146 |
| 4,765,662 | 8/1988 | Suska | 292/92 |
| 5,018,241 | 5/1991 | Baines | 16/82 |

*Primary Examiner*—Richard E. Moore

*Attorney, Agent, or Firm*—Marshall, O'Toole, Gerstein, Murray & Borun

[57] ABSTRACT

A portable handled door stop with an elongated rod, a handle a one end, and a wedge-shaped block at the other end of the rod. The rod extends for a length which is about equal to the distance between the user's hand in the lowermost position of the arm and the floor with the user in an upright position. A molded plastic one-piece construction formed with a cross section similar to an I-beam. A non-skid surface is provided on the base of the unit. A hook-shaped projection at the top end of the door stop enables it to be stored when not in use.

6 Claims, 2 Drawing Sheets

FIG. 3
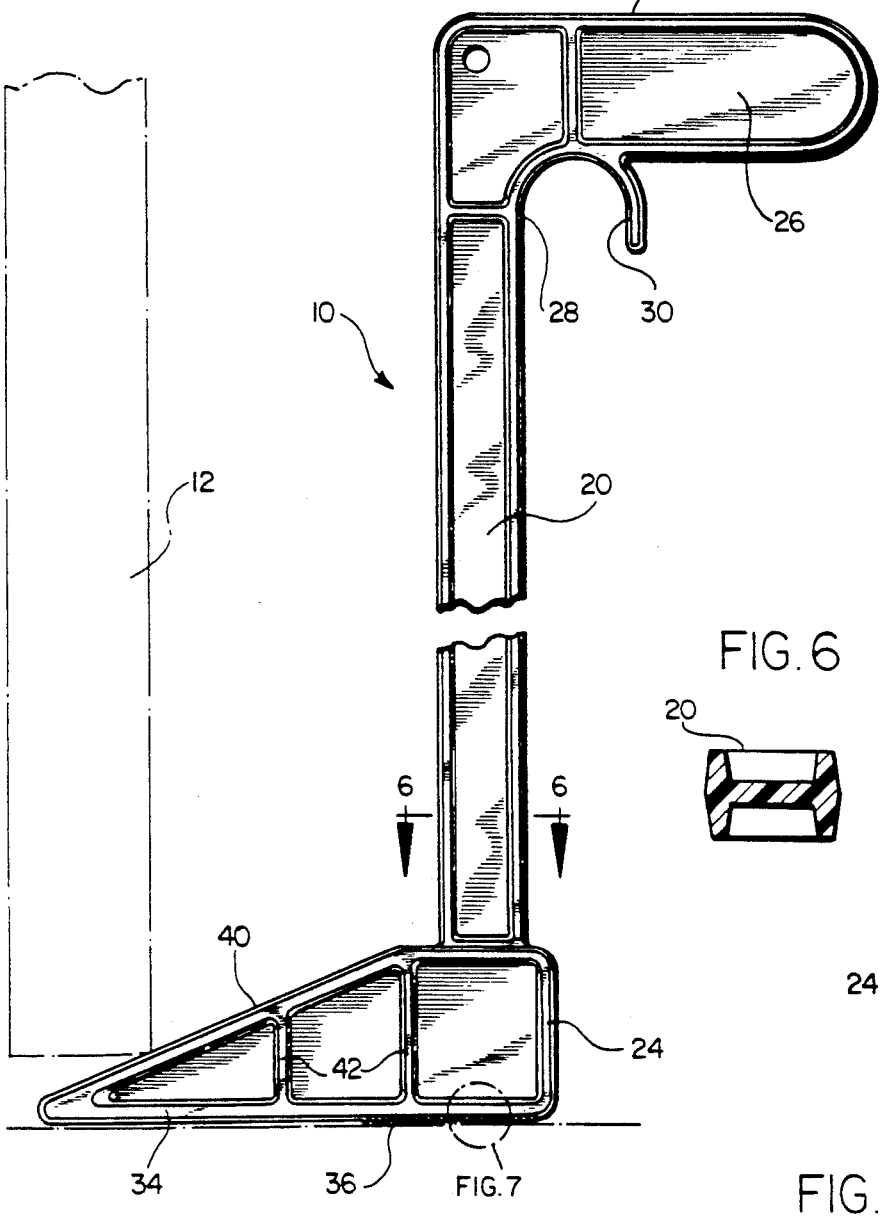
FIG. 4
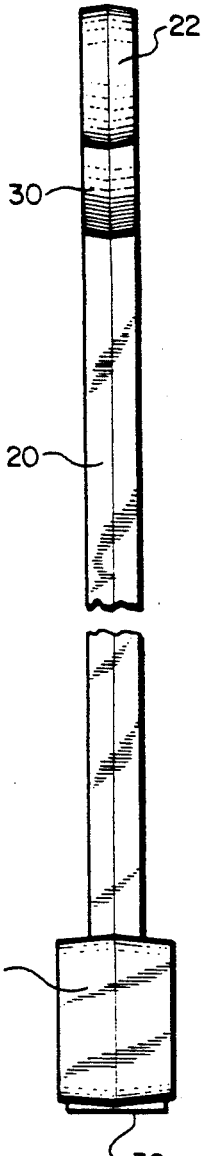
FIG. 6
FIG. 5
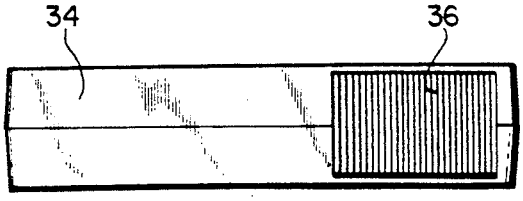
FIG. 7
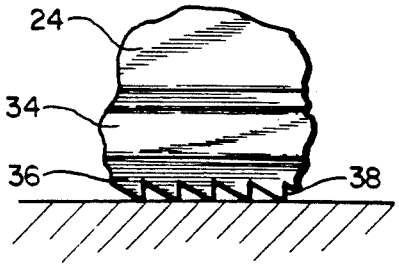

PORTABLE HANDLED DOOR STOP

This invention relates to door stops for maintaining a door in a door stop position, and more particularly to portable door stops insertable and retractable in a door stop position without being affixed to the door or the door frame.

BACKGROUND OF THE INVENTION

Reference may be made to the following U.S. patents of interest: U.S. Pat. Nos. 3,805,322; 3,967,850; 4,216,986; 4,494,784; 4,514,000; 4,648,152; 4,691,958; 4,765,662; 5,018,241.

A variety of door stop units are currently in use or have been proposed. In the above-listed U.S. patents, some show door stops which could be inserted into position or mounted to a door or the door frame and then operated by hand or by foot to secure and release a door from a door stop position. Most of the proposed units are complex in structure and operation. Others require attachment of one or more mechanisms to a door or frame and are thus usable only with a single door once mounted in position.

Portable door stops are currently available which do not have to be mounted in position. Such portable units are normally formed of rubber and are small enough to be hand-carried to a door by the user. The user must then bend down to insert the unit under the door.

There is a presently increasing need for a portable, lightweight door stop which is insertable and removable from a door stop position without bending by the user and with the device being portable for use with more than just a single door. As an example, hotel or motel cleaning personnel must maintain the room doors open while cleaning the rooms. Hotel bellmen, for instance, must also maintain the door in an open position while the luggage is brought into the room.

While there are in use and there has been proposed various door stopping devices, which are affixed or mounted to the door or door frame, such as shown in the above-listed patents, these devices are costly and it is expensive to affix one unit on each door. Furthermore, these fixed devices require additional expenses to maintain them in an operable condition.

A portable, lightweight, door stop which can be readily inserted and removed from an operating position without the user bending also is desirable for use by the elderly, the disabled, or by anyone who cannot or does not want to bend to put the door stop in place or to release it. Preferably, such a device can be readily carried by the user, such as by hooking to his or her belt, so the device can be ready for use. None of the devices shown in the above-listed patents satisfies these needs.

SUMMARY OF THE INVENTION

In accordance with the principles of the present invention, there is provided a lightweight, portable handled door stop having a base insertable and removable from a door stop position with an elongated handle enabling a user to insert and remove the door stop without bending.

The portable handled door stop according to the invention includes an elongated rod extending substantially for a length defined between the floor and the user's hand with the user's hand in its lowermost position when the user is upright. Generally, a rod length of roughly about 30 inches has been found to be of sufficient length to be used by most people. Other lengths are of course usable as long as they conform to the intended use defined above.

The handle extends transversely from one end of the elongated rod for gripping by the user's hand. A wedge-shaped block extends transversely from the other end of the elongated rod and includes a flat base and an inclined surface. The inclined surface extends in an acute angle from the flat base towards the elongated rod and is engageable with the door to maintain the door in a door stop position.

With the user in an upright position and gripping the handle, the wedge-shaped block can readily be inserted and removed from a door stop position by the user without bending. The flat base includes a non-skid surface for aiding in reliably maintaining the wedge-shaped block in position.

In accordance with an important aspect of this invention, a hook-shaped projection is provided at the upper end of the elongated rod. This enables the portable handled door stop to be stored, for instance, on a cleaning person's cart, on a bellman's baggage cart, or on an elderly person's belt.

In the preferred embodiment of the invention, a one-piece lightweight plastic unit is provided with the elongated rod formed with an I-beam cross section for reinforcing the rod. Reinforcing ribs aid in strengthening the wedge-shaped block. Thus, while the portable unit is lightweight, it is sufficiently rigid to reliably act as a door stop.

Alternatively, a multiple piece unit can be utilized. A first wedge-shaped base unit can be formed to fit a second piece elongated rod with a hooked handle so that the base unit can be inserted in position and the rod removed for use in inserting or removing other base units. Either the one-piece or the multiple piece unit embodies the present invention in being able to insert and remove a lightweight, portable door stop with the user in an upright position and without bending by the user.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several figures and in which:

FIG. 3 is a side elevational view of the preferred embodiment of the invention;

FIG. 4 is a front elevational view illustrating the preferred embodiment;

FIG. 5 is a bottom view of the preferred embodiment illustrating the non-skid portion of the base;

FIG. 6 is a cross-sectional view taken along section line 6—6 of FIG. 3; and FIG. 7 is a fragmented exploded view illustrating details of the non-skid base portion.

DETAILED DESCRIPTION

Figure 1:
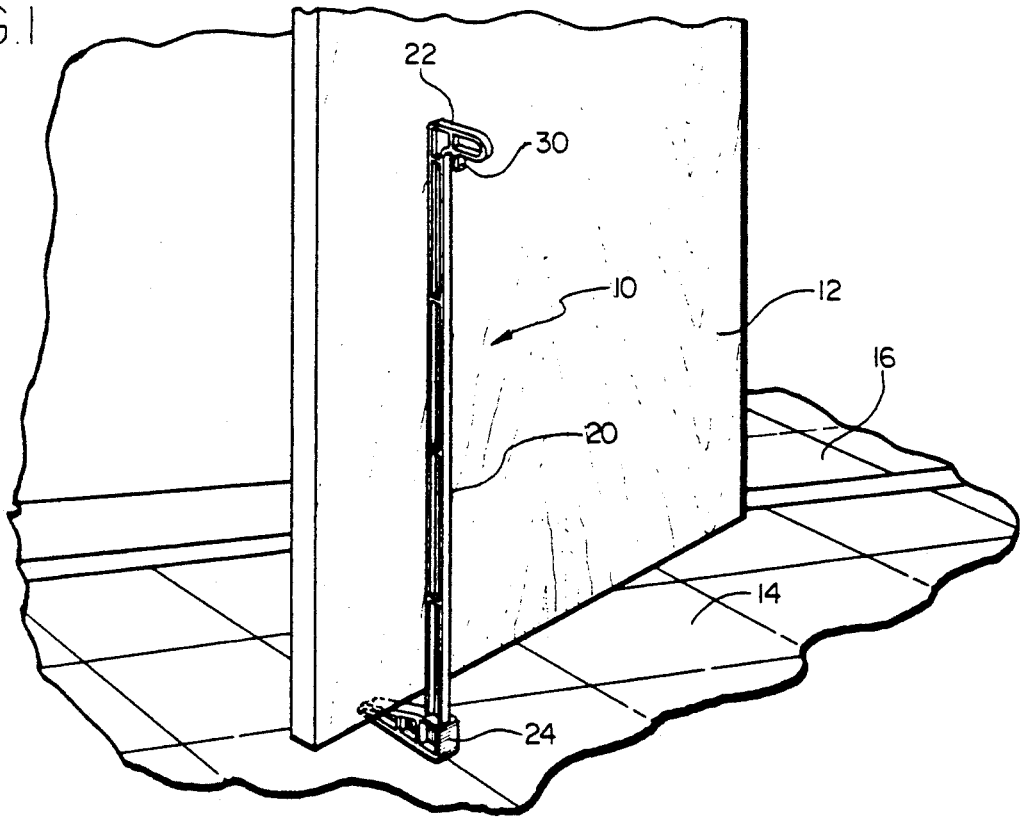
FIG. 1 is a perspective view illustrating a preferred embodiment of the portable handled door stop of the present invention in a door stop position.

Referring now to the drawings, there is illustrated a preferred embodiment of a portable handled door stop in accordance with the principles of the present invention.

Figure 2:
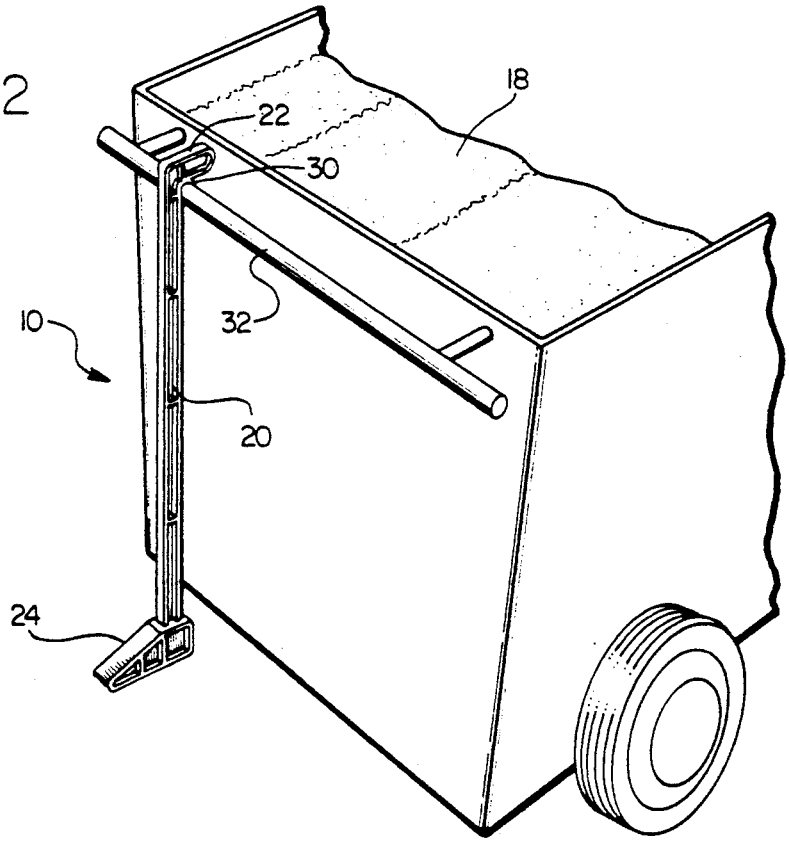
FIG. 2 is a perspective view of the portable handled door stop of FIG. 1 in a movable storage position.

FIG. 1 illustrates a portable handled door stop 10 according to this invention in a door stop position between a door 12 and a floor 14 for maintaining the door 12 in a door stop position with respect to a door frame 16. When the door stop 10 is not in use, FIG. 2 illustrates one of many stored positions wherein door handle 10 is stored for instance on a cleaning person's cart 18. The specific structure of the preferred embodiment of the invention as well as operation and use in a door stop position as well as during storage can be more clearly seen with reference to FIGS. 3–7 and in accordance with the following description.

The preferred embodiment 10 is a molded plastic, one-piece unit which includes an elongated rod 20 which extends for a desired length between an upper handle 22 and a lower wedge-shaped block 24. Elongated rod 20 is roughly about 30 inches long to ensure usage in accordance with this invention. Preferably, the length of rod 20 is sufficient in accordance with the principles of the present invention so that when a user is in the upright position and extends his or her arms downward with the hands in their lowermost position around handle 22, the wedge-shaped block 24 can be inserted and removed from its operating position without the user bending. Thus, rod lengths other than about 30 inches can be sued following the teachings herein.

Handle 22 includes a gripping portion 26 around which a user may encircle his hand with one or more fingers inserted between an upper portion 28 of rod 20 and a trigger-like projection 30. This enables the user to more readily steady the wedge-shaped block at the end of rod 20 when it is being inserted and removed from the door stop position.

In addition, trigger-like projection 30 provides a hook for hanging door stop 10 in the stored position on for instance a bar 32 mounted on a cleaning person's cart 18 as shown in FIG. 2. Projection 30 also enables the door stop to be carried on a person's belt.

To ensure rigidity, rod 20 is formed with an I-beam cross section as shown in FIG. 6. Wedge-shaped block 24 includes a base portion 34 with a flat bottom surface, one end of which includes a non-slip section 36. As shown in the exploded fragmentary view of FIG. 7, non-skid surface 36 is formed with sawtooth-like serrations 38 which are angled so as to resist movement of wedge 24 away from the door 12. An inclined surface portion 40 of wedge-shaped block 24 extends in an acute angle from base portion 34. A series of reinforcing ribs 42 aid in supporting inclined surface 40 above base 34.

Accordingly, with portable handled door stop 10 inserted into a door stop position such as shown in FIGS. 1 and 3, inclined surface 40 is wedged into position under the door 12 with the inclined surface at a sufficient angle so as to accommodate various door heights above the floor. With the preferred embodiment 10, a user grasping handle 22 can readily insert and remove wedge 24 into the door stop position without bending. Upon removal of door stop 10, a cleaning person, for instance may store the unit for use at the next room location by placing projection 30 over bar 32 on cleaning cart 18. The door stop can then be readily removed from its stored position and inserted into the door stop position of FIG. 1. It is understood, of course that the present invention may also be used by bellmen in a manner similar to that shown in FIG. 2, wherein a bellman can insert the portable door stop, with for instance, projection 30 over a similar bar 32 on a bellman's baggage cart. The bellman can readily remove the door stop and insert the same into a door stop position such as shown in FIG. 1.

As can be readily seen from the drawings, handle 22 and wedge-shaped block 24 extend transversely from rod 20 in opposite directions. Notice that in connection with FIGS. 1 and 2, placing the handle and wedge-shaped block on opposite sides of the rod enables the door stop to be placed into the door stop position of FIG. 1 and yet readily enables the door stop to be placed in the storage position of FIG. 2.

It is to be understood that rather than the one-piece unit shown in the present drawings, door stop 10 can be made of multiple units, at least one of which is a separate wedge-shaped block such as block 24 and containing a receiving cavity portion for insertably receiving one end of rod 20. In this manner, the wedge-shaped block can be placed into position using the rod and then the rod is removable for use with additional wedge-shaped blocks 24 or similar items to be used on other doors. In this case only one rod 20 with handle 22 is necessary with a number of wedge-shaped blocks 24.

The foregoing detailed description has been given for clearness of understanding only, and no unnecessary limitations should be understood therefrom, as modifications will be obvious to those skilled in the art.

What is claimed is:

1. A portable handled door stop readily insertable by a user between a door and a floor to maintain a door stop position and readily removable for use with the same or other doors, said portable handled door stop comprising:

an elongated rod extending substantially for a length defined between the floor and the user's hand with the user's hand in its lowermost position and the user upright with respect to the floor;

a handle extending transversely from one end of said elongated rod for gripping by the user's hand;

a wedge-shaped block extending transversely from the other end of said elongated rod, including a flat base and an inclined surface extending at an acute angle from the flat base towards said elongated rod and engageable with the door to maintain said door stop position; and said wedge-shaped block readily insertable and removable from said door stop position by said user while gripping said handle and with said user being upright without bending, and said portable handled door stop not requiring mounting to said door so as to be readily insertable and removable with more than a single door.

2. A portable handled door stop according to claim 1, including a non-skid surface on said flat base for aiding in maintaining said wedge-shaped block in said door stop position.

3. A portable handled door stop according to claim 2, including a hook-shaped projection at said elongated rod one end for storing said door stop when not in use.

4. A portable handled door stop according to claim 3, wherein said elongated rod is formed with an I-beam cross section for reinforcing said rod.

5. A portable handled door stop according to wherein said handle and said wedge-shaped block extend in opposite directions from said elongated rod.

6. A portable handled door stop according to wherein said door stop is formed as a molded, one-piece unit.

* * * * *